US005365753A

United States Patent [19]

Carrola

[11] Patent Number: 5,365,753

[45] Date of Patent: Nov. 22, 1994

[54] BRACELET WITH DECORATIVE ELEMENTS CARRIED ON AN INNER CHAIN

[75] Inventor: Rui Carrola, Fleurier, Switzerland

[73] Assignee: Montres Rado S.A., Lengnau b. Biel, Switzerland

[21] Appl. No.: 997,531

[22] Filed: Dec. 28, 1992

[30] Foreign Application Priority Data

Dec. 31, 1991 [FR] France ..... 91 16459

[51] Int. Cl.[5] ..... A44C 5/02; F16G 13/08

[52] U.S. Cl. ..... 63/4; 59/80

[58] Field of Search ..... 63/3, 4, 9; 59/80

[56] References Cited

U.S. PATENT DOCUMENTS

| | | | |
|---|---|---|---|
| 75,814 | 3/1868 | Turner | 63/4 |
| 1,357,139 | 10/1920 | Bayardi | 63/4 |
| 3,844,136 | 10/1974 | Rieth | 63/4 |
| 3,857,237 | 12/1974 | Brauchi | 63/4 |
| 4,821,532 | 4/1989 | Jaques | 63/9 |
| 4,930,304 | 6/1990 | Meister | 63/4 |

FOREIGN PATENT DOCUMENTS

| | | | |
|---|---|---|---|
| 0277590 | 8/1988 | European Pat. Off. . | |
| 604594 | 9/1978 | Switzerland . | |
| 661184 | 7/1987 | Switzerland . | |
| 669882 | 4/1988 | Switzerland | 63/3 |
| 9117679 | 11/1991 | WIPO | 63/3 |

*Primary Examiner*—Flemming Saether
*Attorney, Agent, or Firm*—Weil, Gotshal & Manges

[57] ABSTRACT

The bracelet (1) according to the invention includes an inner chain (2) made up of articulated links (4) including a central part (8) from which two lateral arms (14) project. The bracelet (1) further includes a plurality of decorative elements (6) strung onto the inner chain (2) and blocking means for each decorative element (6) on the chain (2). According to the invention each blocking means comprises a blocking element (38) which is positioned on the chain (2) and which comprises two projecting parts (42) extending laterally beyond arms (14) and, each decorative element (6) comprises a passage (58) provided with a shoulder (60) which bears against the projecting parts (42) when such element (38) is arranged on the chain (2) and the decorative element (38) is strung on said chain.

13 Claims, 9 Drawing Sheets

BRACELET WITH DECORATIVE ELEMENTS CARRIED ON AN INNER CHAIN

This invention concerns a bracelet with links, in particular for a watch and more specifically a bracelet including a chain of inner links on which are strung decorative elements of ceramic.

BACKGROUND OF THE INVENTION

There is already known from patent document FR 2 633 164 a bracelet including an inner chain made up of articulated links on which are strung decorative elements.

The links of the chain each include a central part from which two lateral arms extend and are coupled among themselves by a hinge arrangement which includes insertion of the central part of the link between the arms of the following link. The central part and the arms of each link are provided with holes intended to receive connection pins which pivotally couple the links one after the other. Furthermore, the bracelet includes a plurality of decorative elements arranged side by side strung on the inner chain and partially surrounding this latter. The connection axes project from the two lateral sides of the inner chain and cooperate with cross-piercings provided in the lateral parts of the decorative elements in order to retain or block the decorative elements on the inner chain. The blocking of the decorative elements on the inner chain prevents any displacement of the elements relative to the chain so that one avoids any articulation problem.

Although the construction of the retaining or blocking means of the decorative elements on the inner chain with the help of the connection axes is itself effective, it nevertheless exhibits certain difficulties.

Effectively, making cross-piercings in the decorative elements practically excludes the possibility of choosing hard materials such as ceramic which is presently very much in fashion, if one does not wish to increase the price of the bracelet in a prohibitive manner in performing costly machining or moulding operations on the decorative elements.

Furthermore, such piercings remain exteriorly visible following assembly of the bracelet and spoil the general appearance of the bracelet which goes against the generally sought-after purpose in the manufacture of bracelets, that is to say, to render the bracelet as attractive as possible for the consumer.

The invention thus has as purpose to overcome the difficulties of the above-mentioned prior art in providing a design of bracelet with links including decorative elements which in particular enables utilization of hard materials for forming the decorative elements without increasing considerably the cost price of the bracelet on the one hand and without spoiling the attractiveness of the appearance on the other hand.

To this end, the invention has as objective a bracelet including an inner chain made up of articulated links extending in a longitudinal direction, each link including a central part from which two lateral arms project and said links being coupled together by a hinge arrangement which includes insertion of the central part of a link between the arms of the following link, said central part and said arms being provided with holes for receiving pins pivotally coupling said links one after the other, said bracelet further including a plurality of decorative elements arranged side by side, strung onto the inner chain and at least partially surrounding such latter, and blocking means for each decorative element relative to the inner chain.

SUMMARY OF THE INVENTION

In conformity with the invention, each blocking means comprises a blocking element positioned on said inner chain, said blocking element comprising two projecting parts extending laterally beyond said lateral arms in a direction perpendicular to the longitudinal direction of the bracelet, each decorative element comprising a passage provided with a shoulder, said shoulder being brought to bear against said projecting parts of the blocking element when such latter is arranged on the inner chain and the decorative element is strung onto the inner chain.

Thanks to these characteristics, there is obtained a bracelet comprising a chain of links on which are strung a plurality of decorative elements and in which such elements are maintained in place on the inner chain with the help of means which are not visible from the exterior of the bracelet and which consequently do not in any manner spoil its attractive appearance.

It will also be noted that in an advantageous manner, the decorative elements are provided with only one passage in order to be strung on the inner chain so that they may be directly formed by injection or compression with ultimate sintering. The use of any hard material such as ceramic or others may be foreseen without requiring burdensome machining operations.

Another important point to be underlined is that the structure of the bracelet with links according to the invention does not complicate either its assembly or its respective shortening or lengthening.

Other advantages and characteristics of the invention will clearly appear upon reading of the following description of the embodiments of the invention given by way of non-limiting illustration in connection with the attached drawings.

DESCRIPTION OF THE PREFERRED EMBODIMENTS

Referring initially to FIGS. 1 to 11, there will be seen a first embodiment of the bracelet according to the invention, designated by the general reference number 1. Such bracelet I includes an inner chain 2 made up of articulated links 4 all of which are identical and onto which are strung a plurality of decorative elements 6, two only of which have been shown on FIG. 1.

Figure 1:
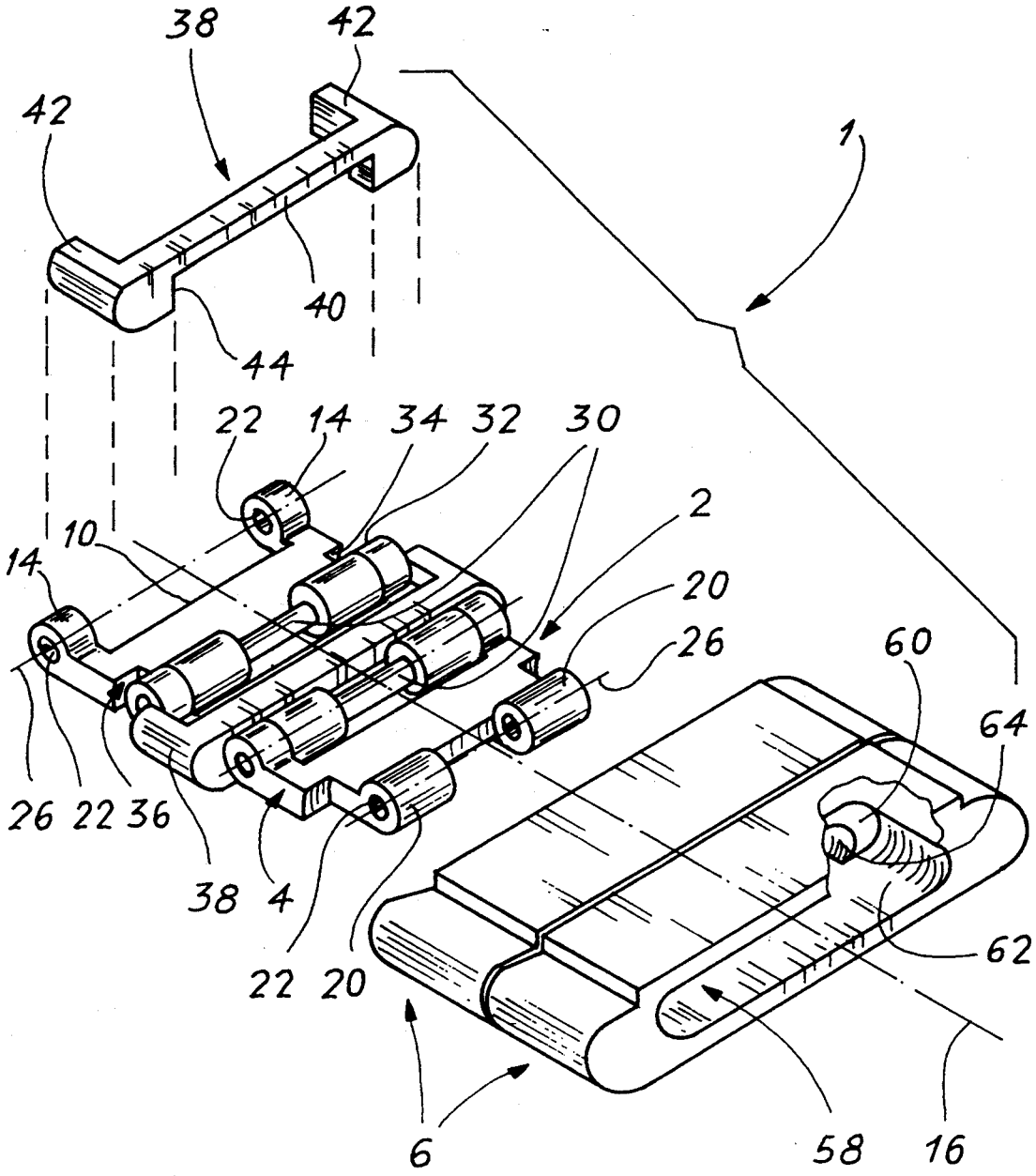
FIG. 1 is an exploded perspective view of a first embodiment of the invention.
Figure 4:
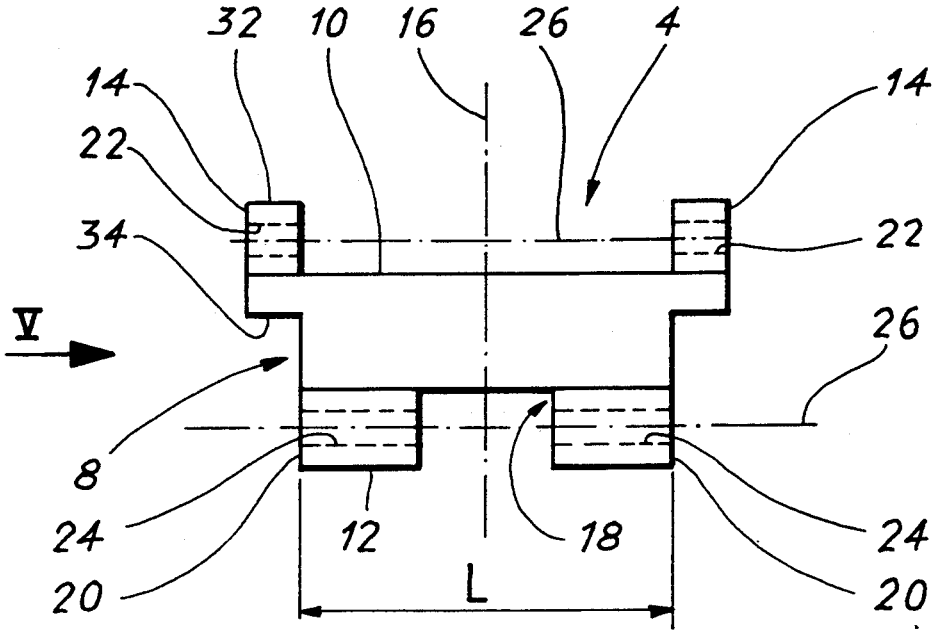
FIG. 4 is a top view of an inner link making up the first embodiment of the bracelet according to the invention.

Each link 4 includes a central part 8 comprising a forward edge 10 and a rear edge 12 relative to the position of the link on FIGS. 1 and 4. Two lateral arms 14 project from the forward edge 10 of the central part. Such arms 14 extend parallel to the longitudinal direction of the bracelet represented by axis 16 on the drawing, and are laterally separated relative to the width L of the central part 8. Such latter exhibits on its rear edge 12 and substantially at its center a recess 18 forming projections 20 on either side of this latter. Lateral arms 14 as well as projections 20 are respectively traversed by holes 22, 24 for pins extending along the articulation axes of one link relative to its neighboring link.

Figure 5:
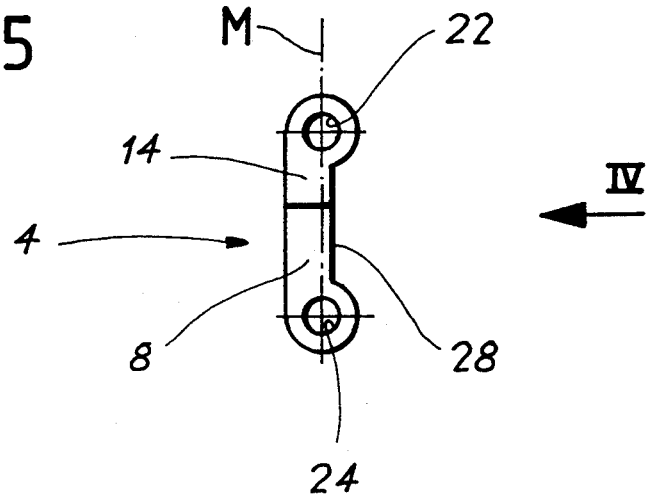
FIG. 5 is a view according to arrow V of FIG. 4.

As is particularly visible on FIGS. 1 to 5, the central part 8 of each link shows a face 28 which is lowered relative to the plane M passing through the articulation axes 26 and shown by an interrupted line on FIG. 5. Such lowering of face 28 forms a housing, the use of which will be explained hereinafter.

It is well understood that the central part 8 is not limited to the rectangular form shown on the drawing and may have other configurations. In this respect the central part 8 may not include the recess 18 according to a variant. In such case the pin holes 24 are replaced by two blind holes.

Links 4 are coupled together by means of a hinge assembly arrangement including, in the case of the example shown on FIG. 1, the insertion of the central part 8 between the lateral arms ! 4 of the following link together with the putting into place of pins 30 into the holes 22, 24 . Such pins 30 are either driven into holes 22 and free in holes 24 or free in holes 22 and driven into holes 24.

Figure 3:
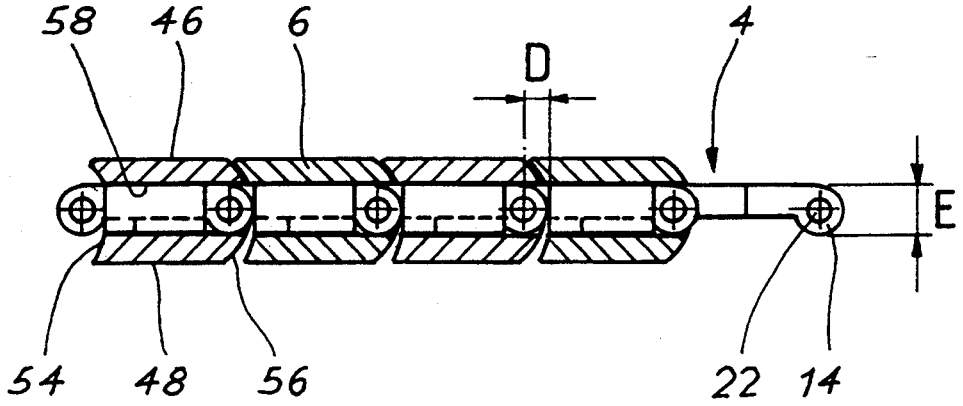
FIG. 3 is a cross-section along line III—III of FIG. 2 of a first embodiment of the invention.
Figure 2:
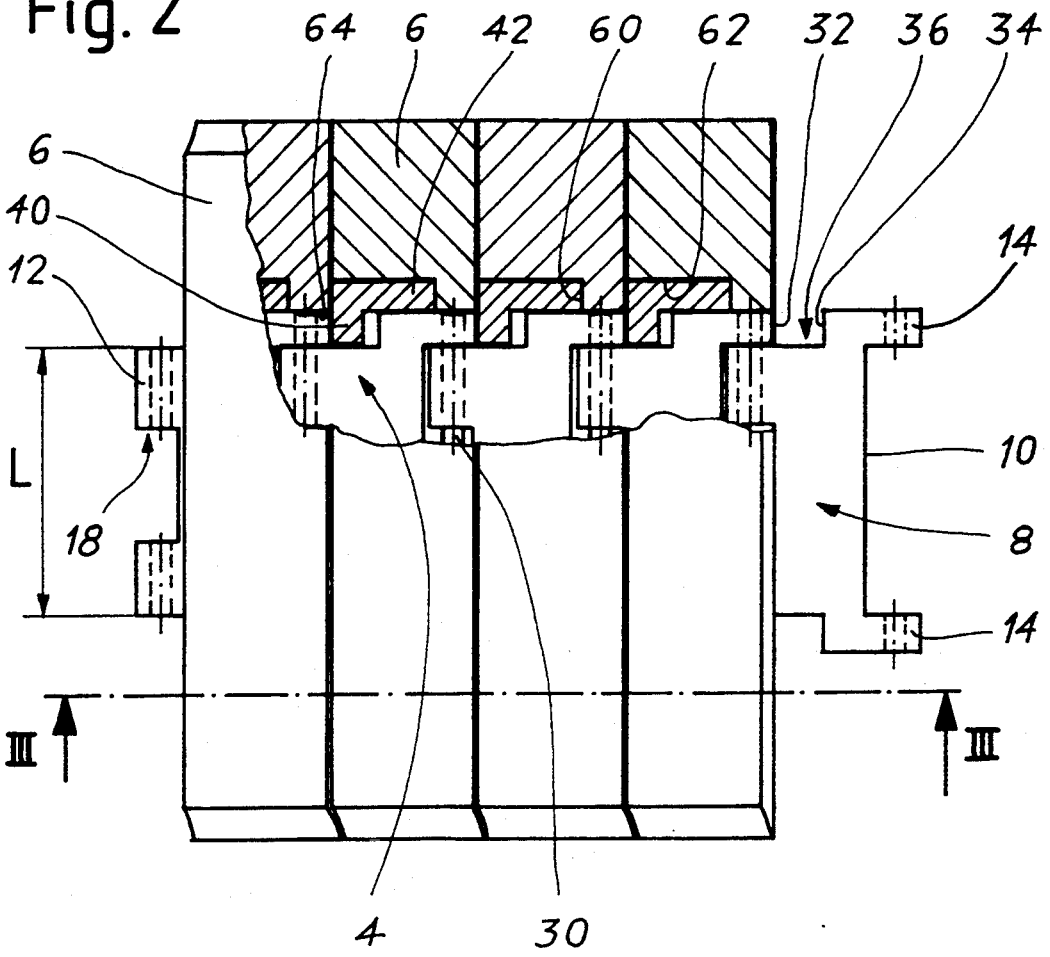
FIG. 2 is a top view, partially cut away, of the embodiment of the bracelet according to the invention shown on FIG. 1, said bracelet being assembled.

In referring to FIG. 3, it will be seen that, according to an important characteristic of this embodiment of the bracelet, the distance between axes 26 of holes 22 and 24 of a link is such that when the central part 8 of such link is inserted and articulated between the laterals arms 14 of its neighboring link, the ends 32, 34 of the facing arms 14 bound a free space 36.

Such free space 36 together with the housing formed by lowering face 28 provide nesting means for a blocking or retaining element 38 of the decorative elements relative to the inner chain 2 which is shown on FIG. 1 , once in place on chain 2 and a second time in a position above chain 2 in which it is ready to be put into place.

Figure 6:
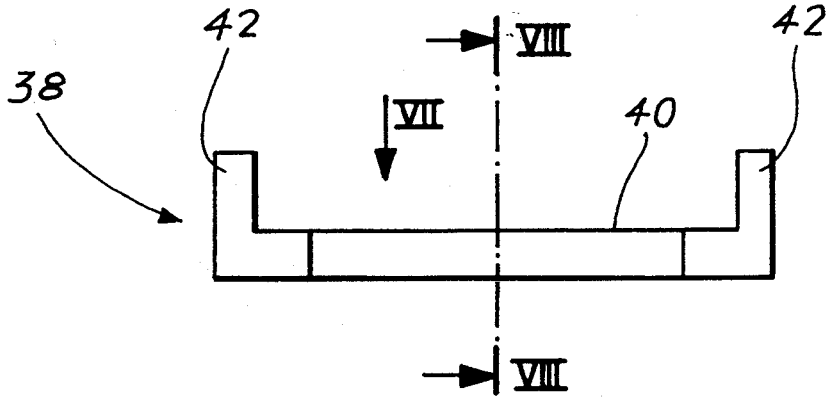
FIG. 6 is a top view of the blocking means of the decorative elements on the inner chain according to the first embodiment of the bracelet according to the invention.
Figure 7:
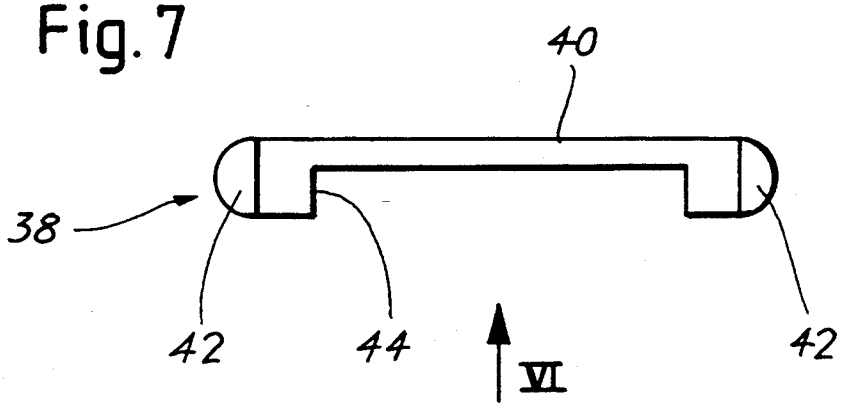
FIG. 7 is a view according to arrow VII of FIG. 6.
Figure 8:
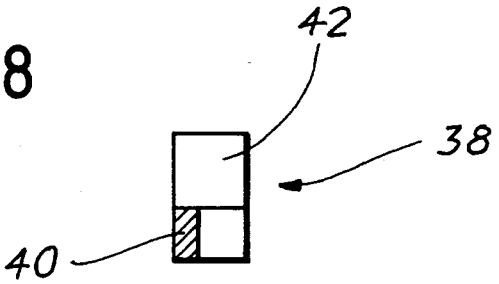
FIG. 8 is a cross-section according to line VIII—VIII of FIG. 6.

Referring more specifically to FIGS. 6 to 8 , it is seen that the blocking element 38 has the general form of a C which shows a central limb 40 and two lateral limbs 42 forming lateral projections. The central limb 40 comprises a recess 44 in the median part of its face extending parallel to the direction of lateral limbs 42 . In the embodiment shown, each of the lateral limbs 42 exhibits a cross-section in the form of a half-moon with their rectilinear parts facing one another (FIG. 7) .

The dimension perpendicular to the longitudinal direction 16 of the recess is substantially equal to the width L of the central part 8 of the links. Furthermore, the longitudinal dimension of the central limb 40 of the blocking element 28 is substantially less than the longitudinal dimension of the lowered face 28 of links 4. As far as concerns the thickness of the central limb 40 in the zone where the recess 44 is provided, it is such that when the blocking element is positioned on chain 2, the thickness of the assembly does not exceed the greatest thickness E of link 4.

Finally, according to another important characteristic of the invention, the lateral limbs 42 of the blocking element 38 parallel to the longitudinal direction of the bracelet extend in a direction perpendicular to this latter, beyond the lateral arms 14. The set of such characteristics is clearly visible on FIGS. 1 to 3.

Figure 9:
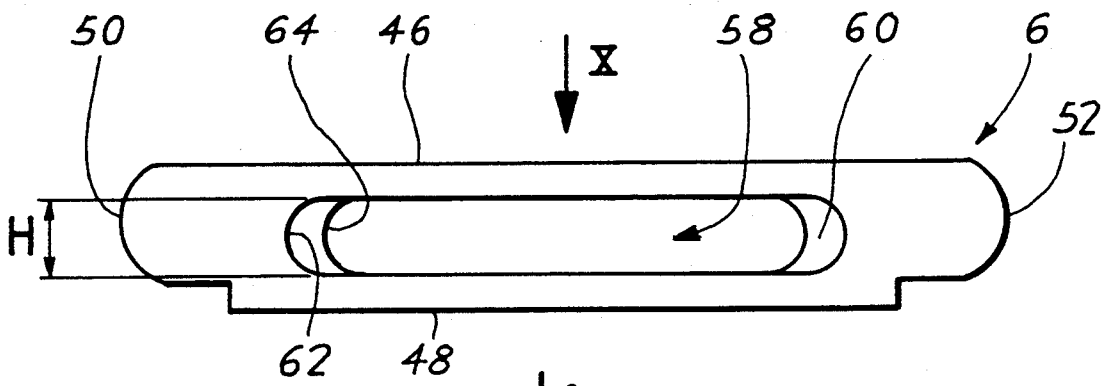
FIG. 9 is a face view of a decorative element making up the bracelet of FIG. 2.
Figure 10:
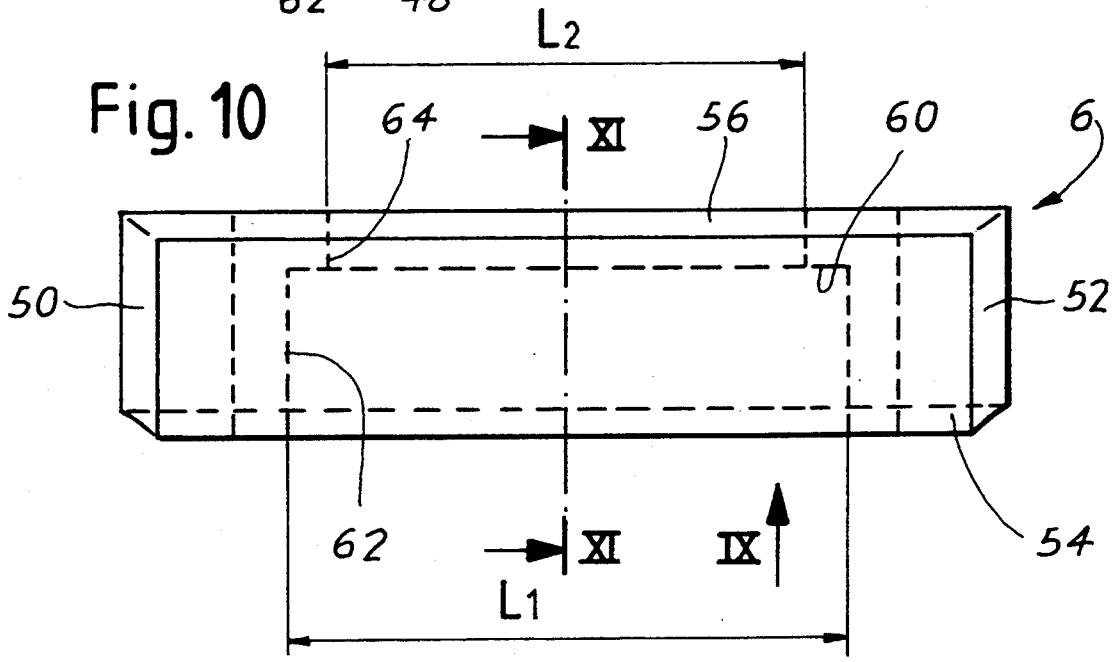
FIG. 10 is a view according to arrow X of FIG. 9.
Figure 11:
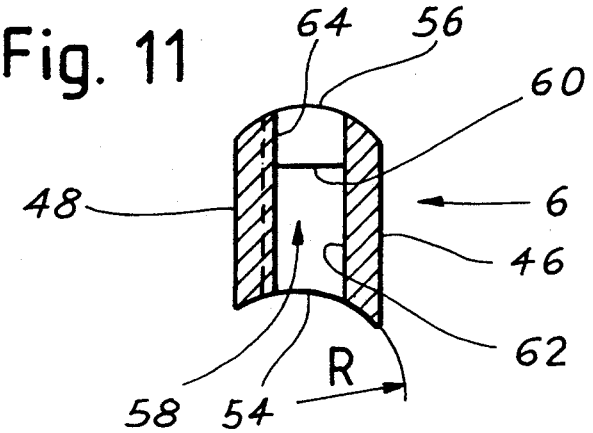
FIG. 11 is a cross-section along line XI—XI of FIG. 9.

Referring now also to FIGS. 9 to 11, there is seen a decorative element 6 which has the general configuration of a rectangular parallelepipedon including two wide opposed sides 46, 48 exhibiting a generally planar face, two small opposed sides 50, 52 exhibiting a convex rounded face and two other small opposed sides exhibiting respectively a concave rounded face 54 referred to as front face and a convex rounded face 56 referred to as rear face.

The wide sides 46, 48 and the small sides 50, 52 extend in a direction parallel to the longitudinal direction of the bracelet while the other two small sides 54, 56 extend in a direction perpendicular to this latter.

Such decorative element 6 includes, furthermore, a passage 58 of oblong form provided with a shoulder 60. Passage 58 comprises thus a first part 62 having a first width L1 opening out on the side of the forward face 54 and a second part 64 having a second width L2, less than the first, opening out on the side of the rear face 56, the height H of passage 58 being identical in the first and second parts thereof and substantially greater than the thickness E of the links of chain 2. Furthermore, the lateral ends of passage 58 are rounded off in order to conform to the lateral ends of limbs 42 of the blocking element and the length of the first part 62 of the passage according to a characteristic of the invention, is equal or substantially equal to the length of the limbs 42 of the blocking element.

According to another characteristic of the invention, radii R of the front and rear faces 54, 56 of the decorative elements are identical and the length of the second part of the passage is such that the distance D separating the articulation axes 26 and the top of the rounded-off rear face 56 is substantially equal to the radius R when the decorative elements are installed on the inner chain 2.

It will be noted in this respect that the structure defined hereinabove enables the obtaining of a junction without play between the decorative elements during pivoting of the links 4 around pins 30.

Additionally, distance D is easily adjustable by modifying the form of the blocking element 36, for example by modifying the length of its limbs 42. This principle is thus in no manner limitative in the choice of radii of the rounded-off faces of the decorative element.

The decorative element 6 may be manufactured by use of the most varied materials. There has been given, in the example shown, preference to a ceramic element, rich in appearance and which may be sintered to dimensions sufficiently precise in order that no further retouching is necessary except for a polishing operation.

It will be noted that according to the structure of the bracelet of the invention, traction exerted on the bracelet is applied solely to the inner chain and that the decorative elements do not undergo any such. This, as is well understood, is particularly advantageous in cases where a fragile material such as ceramic is used for such decorative elements. It remains nonetheless that other materials could be employed, such as hard metal or simply steel or again an alternation of elements exhibiting different colours.

Although in the example shown the decorative elements completely surround the inner chain, such elements can, according to a variant of the embodiment, cover only partially the chain and, for example, comprise only an upper part which entirely covers the inner chain and two lateral parts which cover respectively the side edges of the chain.

In order to assemble the bracelet which has just been described in detail, one proceeds in the following manner. The inner chain 2 is formed to the desired length in inserting links 4 and in coupling them together in a standard manner by means of pins 30 following which one arranges a first blocking element 38 on chain 2, the face of limb 40 including the recess 44 being directed facing surface 28 of link 4. A first decorative element 6 may then be strung via part 62 of passage 58. Shoulder 60 then comes to bear against the free end of limbs 42 of the blocking element 38 , itself being blocked on the inner chain 2 by its central limb 40 bearing against the ends 32 of arms 14 of the preceding link. The decorative element 6 is then held in a correct position and the following blocking element may be arranged and the associated decorative element strung. One proceeds in the same manner for assembling the following decorative elements until the last thereof. According to one embodiment, each side 50, 52 of the last decorative element is provided with a piercing into which penetrates one of the ends of a pin which extends laterally beyond arms 14 of the last link 8.

Figure 12:
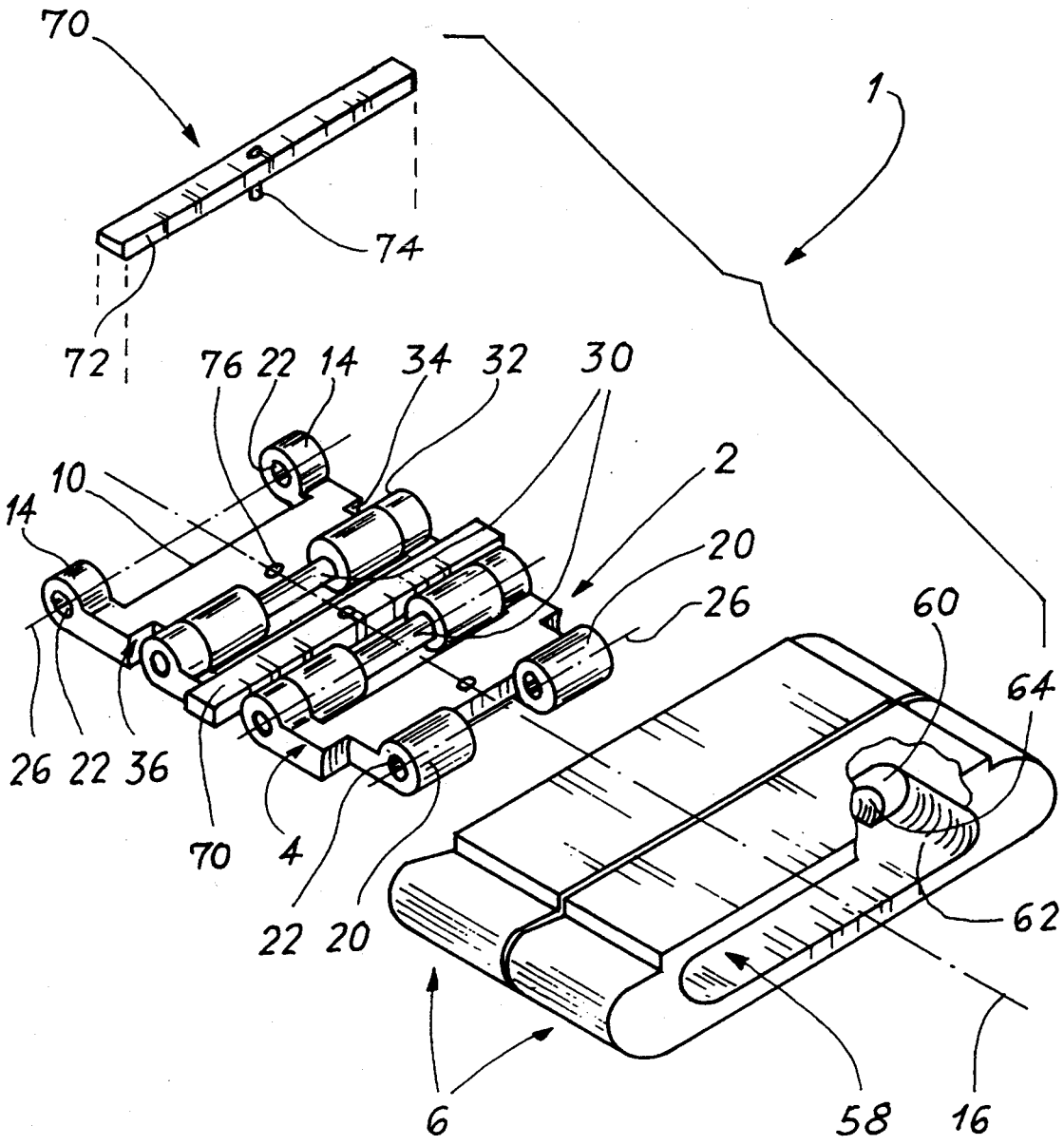
FIG. 12 is an exploded perspective view of a second embodiment in accordance with the invention.

Referring now to FIG. 12, there will be seen a second embodiment of a bracelet with links according to the invention, in which the elements identical to those previously described are designated by the same reference numerals.

In this embodiment, while the decorative element 6 is identical to that described in connection with FIGS. 1 to 11, the blocking element 70 has the form of a bar provided on one of its major faces 72 with a projecting element 74 , and each link 4 forming the inner chain 2 exhibits an opening 76 intended to cooperate with said projecting element 74. The projecting element 74 is arranged substantially in the median part of bar 70 and opening 76 is provided in the lowered face 28 of each link 4 . It is self-evident that according to a variant there may be envisaged an inverse arrangement of the projecting element and the opening.

As is well understood, the thickness of bar 70 is such that when it is arranged on its associated link, the total thickness of the assembly does not exceed the greatest thickness of the link.

Figure 13:
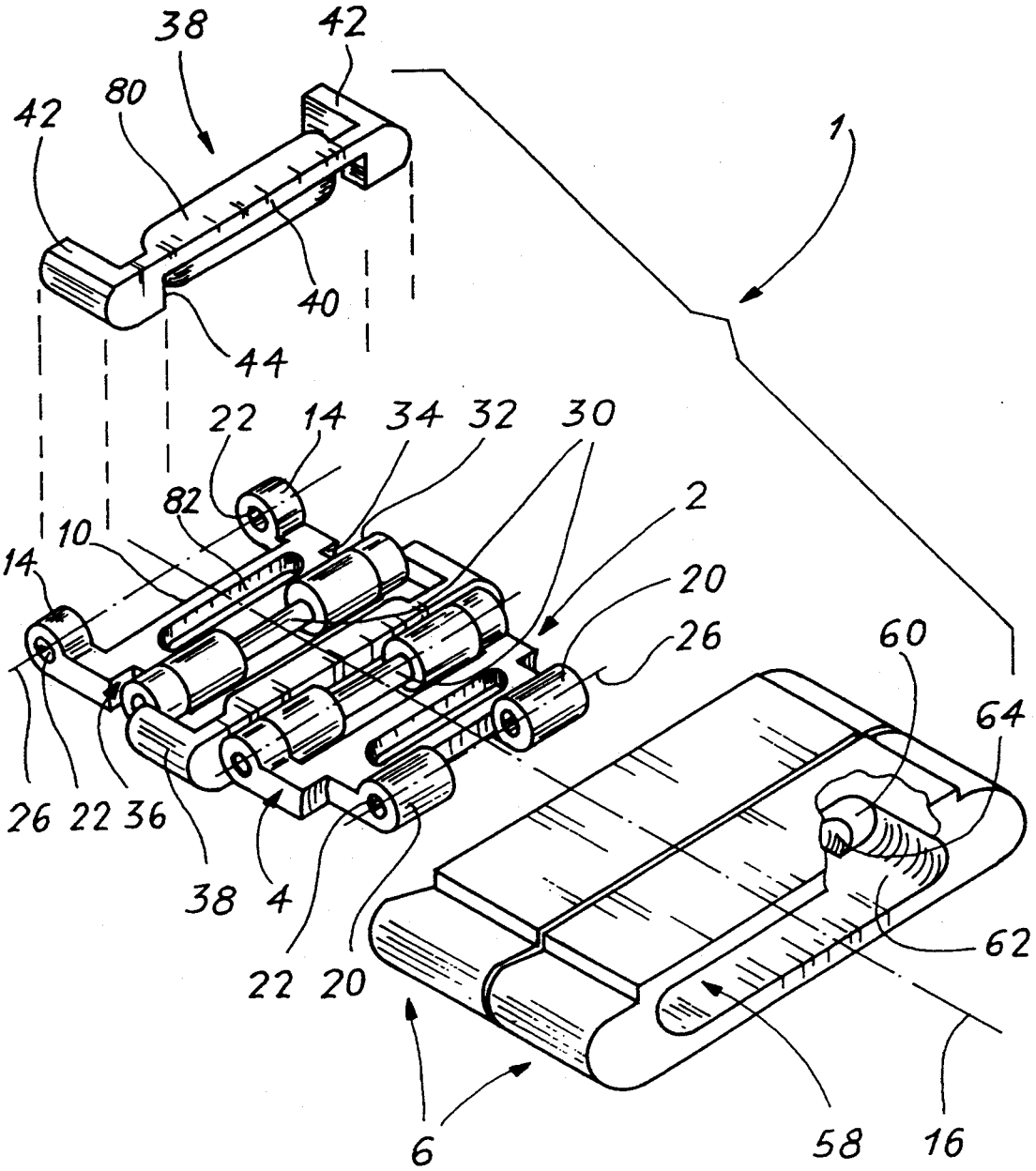
FIG. 13 is an exploded perspective view of a third embodiment in accordance with the invention.

In referring to FIG. 13, there will be seen a third embodiment of a bracelet with links according to the invention, in which the elements identical to those previously described are designated by the same reference numerals.

In this third embodiment, the central limb 40 of each blocking element 38 has a central projection 80 extending between the limbs 42 of the blocking element 38 and substantially away from its extremities. Like that indicated in the figure, the projection 80 may be placed in an oblong recess 82 which is located for this purpose in the central part 8 of the link 2. It will be noted that the thickness of the projection 80 is substantially equal to that of the blocking element.

In this case, the blocking element 38 can easily be made, for example by moulding, from synthetic material. This structure thus advantageously allows the weight of the bracelet to be reduced whilst retaining good rigidity of the interior chain.

Figure 14:
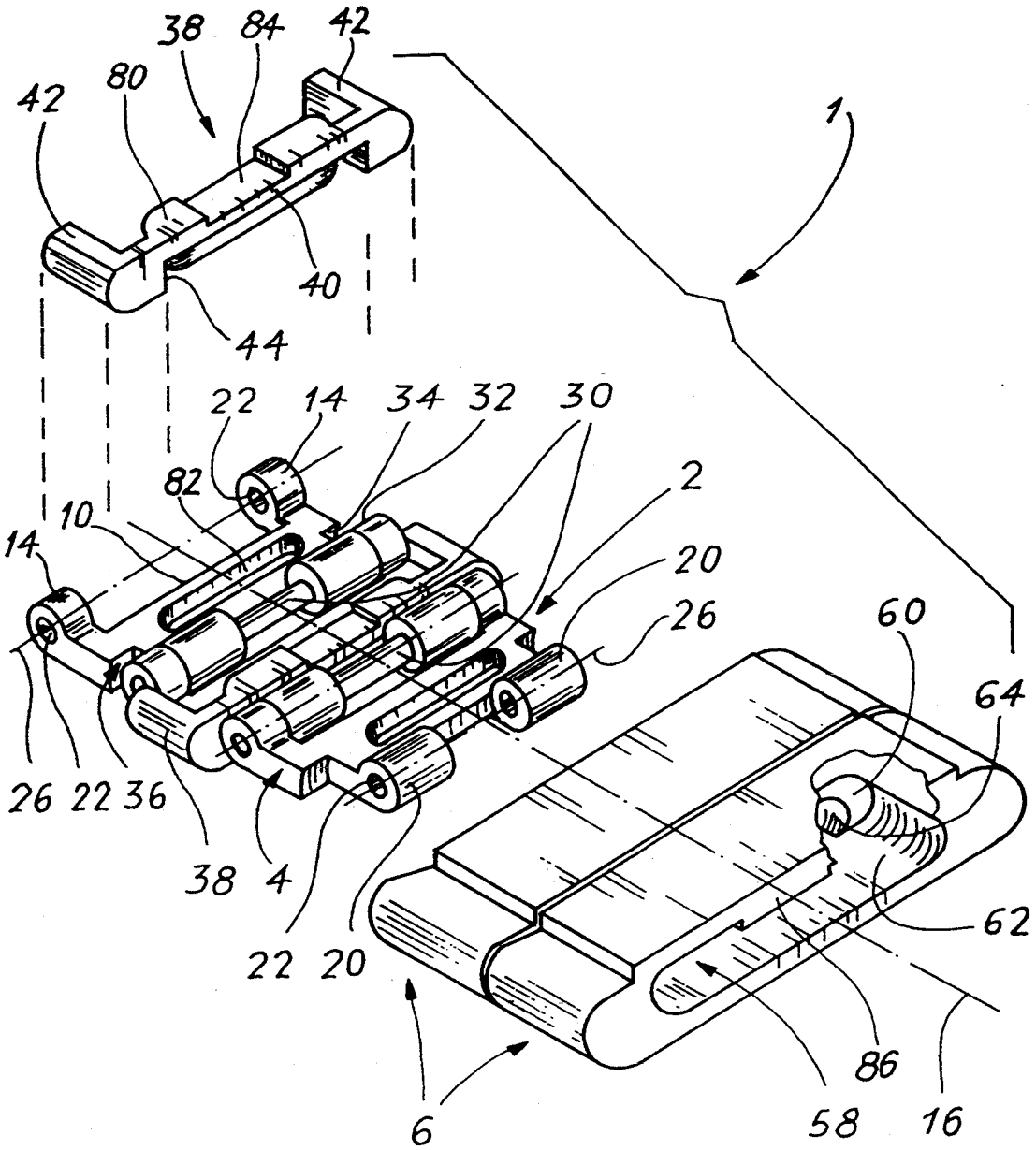
FIG. 14 is an exploded perspective view of a variation of the third embodiment in accordance with the present invention.
Figure 15:
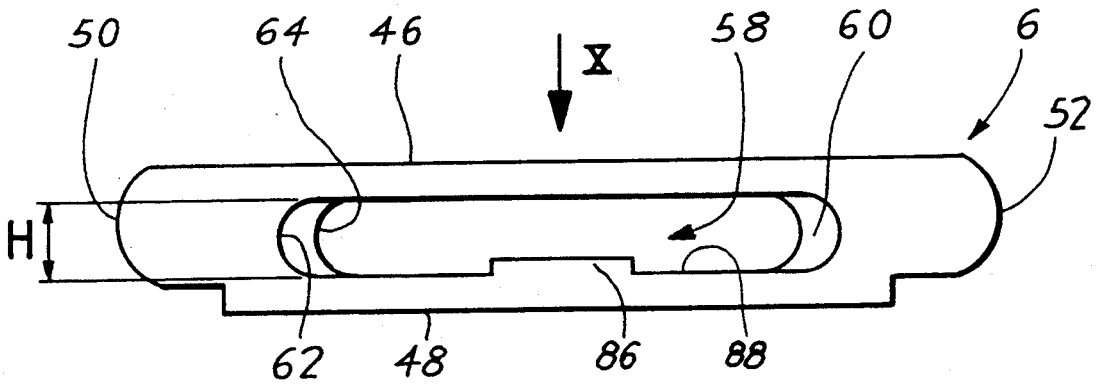
FIG. 15 is a face view of a decorative element making up the bracelet of FIG. 14.

According to the variation of the third embodiment shown in FIGS. 14 and 15, the projection 80 of each blocking element comprises centrally and on one side of its thickness a groove 84 which extends parallel to the longitudinal direction of the bracelet. The groove 84 may cooperate with a rib 86 located for this reason on a wall 88 of the passage 58 of the decorative element 6 to which it is associated and along its entire length- The groove 84 and rib 86 together form centering means of the decorative elements 6 on the interior chain 2 and thus prevent unaesthetique lateral shifting of one of the decorative elements with respect to the others.

Although the invention has been described in connection with two preferred embodiments, other variants and modifications such as changes in form or dimensions may be apparent to the person skilled in the art without departing from the framework of the invention.

What I claim is:

1. A bracelet including an inner chain comprising a series of articulated links extending in a longitudinal direction, each link including a central part and two lateral arms projecting from said central part, the central part of each link being inserted between the lateral arms of the following link of said series, said central part of said lateral arms having aligned transverse holes therein, pins inserted in said aligned holes for pivotally coupling each link to the adjacent links of said series, said bracelet further including a plurality of decorative elements arranged side by side, strung onto and at least partially surrounding the inner chain, and a blocking element for each decorative element for positioning said decorative element relative to the inner chain, each blocking element positioned on said inner chain and comprising two projecting parts extending laterally beyond said lateral arms in a direction perpendicular to the longitudinal direction of the bracelet, each decorative element comprising a passage having a shoulder, said shoulder bearing against said projecting parts of the blocking element when the blocking element is arranged on the inner chain and the decorative element is strung onto the inner chain.

2. A bracelet as set forth in claim 1 wherein the blocking elements are positioned on the inner chain by nesting means.

3. A bracelet as set forth in claim 1 wherein said lateral arms each have two ends, each end facing an end of the lateral arms of the adjacent links of said series, the facing ends of two successive links of the inner chain bounding a free space.

4. A bracelet as set forth in claim 3 wherein each said blocking element has the form of a C having a central limb and two lateral limbs, said lateral links forming said projecting parts, and in which said central limb extends over the central part of the link, said projecting parts fitting into said free spaces.

5. A bracelet as set forth in claim 4 wherein the central limb of the blocking element as well as a portion of the central part of the link onto which it is fitted each includes a recess.

6. A bracelet as set forth in claim 1 or in claim 2 wherein said blocking elements each includes a projecting element and the links forming the inner chain each have an opening cooperating with the projecting element of the corresponding blocking element.

7. A bracelet as set forth in claim 6 wherein each link includes a recess in the central part thereof, and each blocking element has the form of a bar which fits into the recess of the corresponding link.

8. A bracelet as set forth in claim 6, wherein each blocking element has a centrally located projection which extends between the lateral arms for cooperating with a oblong recess in the central part of the corresponding link.

9. A bracelet as set forth in claim 8, wherein the decorative elements each include a rib on a wall of the passage thereof, and the blocking element comprises centrally and on one side of its thickness a groove extending parallel to the longitudinal direction of the bracelet for cooperating with the rib of the decorative element to which it is associated to form means of centering the decorative elements on the inner chain.

10. A bracelet as set forth in claim 1 wherein each of said projecting parts has a cross-section having a half-moon form with their rectilinear parts facing one another.

11. A bracelet as set forth in claim 1 wherein said passage has an oblong cross-section.

12. A bracelet as set forth in claim 1 wherein the decorative elements completely surround said inner chain.

13. A bracelet as set forth in claim 1 wherein the decorative elements are of ceramic.

* * * * *